United States Patent [19]

Rosner

[11] Patent Number: 4,470,234

[45] Date of Patent: Sep. 11, 1984

[54] HOLLOW BEAM CONSTRUCTED OF BOARDS

[76] Inventor: Wolfgang Rosner, Josephsburgstrasse 73a, D-8000 München 80, Fed. Rep. of Germany

[21] Appl. No.: 224,039

[22] Filed: Jan. 12, 1981

[30] Foreign Application Priority Data

Jan. 16, 1980 [DE] Fed. Rep. of Germany ..... 3001445

[51] Int. Cl.[3] ..... E04C 1/04

[52] U.S. Cl. ..... 52/282; 52/731; 52/DIG. 8

[58] Field of Search ..... 52/731, 282, 311, DIG. 8, 52/285, 464, 463, 281

[56] References Cited

U.S. PATENT DOCUMENTS

| | | | |
|---|---|---|---|
| 1,590,890 | 12/1922 | Easterman | 52/282 |
| 1,779,346 | 5/1929 | Trachte | 52/463 |
| 2,373,789 | 4/1943 | Smith | 52/282 |
| 2,444,133 | 6/1948 | Groat et al. . | |
| 2,572,947 | 10/1951 | Pevney | 52/282 |
| 3,126,986 | 3/1964 | Madl, Jr. | 52/464 |
| 3,762,113 | 10/1973 | O'Mullan et al. | 52/DIG. 8 |

FOREIGN PATENT DOCUMENTS

| | | | |
|---|---|---|---|
| 0014626 | 4/1882 | Canada . | |
| 0279714 | 5/1928 | Canada . | |
| 7027753 | 11/1970 | Fed. Rep. of Germany . | |
| 7434091 | 3/1975 | Fed. Rep. of Germany . | |
| 2520507 | 9/1976 | Fed. Rep. of Germany | 52/731 |
| 2515597 | 10/1976 | Fed. Rep. of Germany | 52/DIG. 8 |
| 7717382 | 9/1977 | Fed. Rep. of Germany . | |
| 2613675.4-25 | 10/1977 | Fed. Rep. of Germany | 52/282 |
| 7801530 | 8/1978 | Fed. Rep. of Germany . | |
| 2711367 | 9/1978 | Fed. Rep. of Germany . | |
| 2724838 | 12/1978 | Fed. Rep. of Germany | 52/311 |
| 1197540 | 12/1959 | France | 52/DIG. 8 |
| 0654809 | 6/1951 | United Kingdom | 52/282 |

*Primary Examiner*—James L. Ridgill, Jr.
*Attorney, Agent, or Firm*—Spencer & Frank

[57] ABSTRACT

A hollow beam having longitudinally extending sides arranged in a beam-shape. The beam has corner members which interconnect adjacent pairs of sides to define respective corners of the beam. The corner members include longitudinally extending tongues and grooves which engage cooperating parts provided on adjacent ones of the sides. There are a plurality of clips provided at spaced intervals along the length of each respective corner, the opposed ends of the clips engaging longitudinally extending recesses formed into the inner surfaces of the sides adjacent the respective corner members. In addition, an attachment is provided which securely connects each clip to the respective corner member.

7 Claims, 1 Drawing Figure

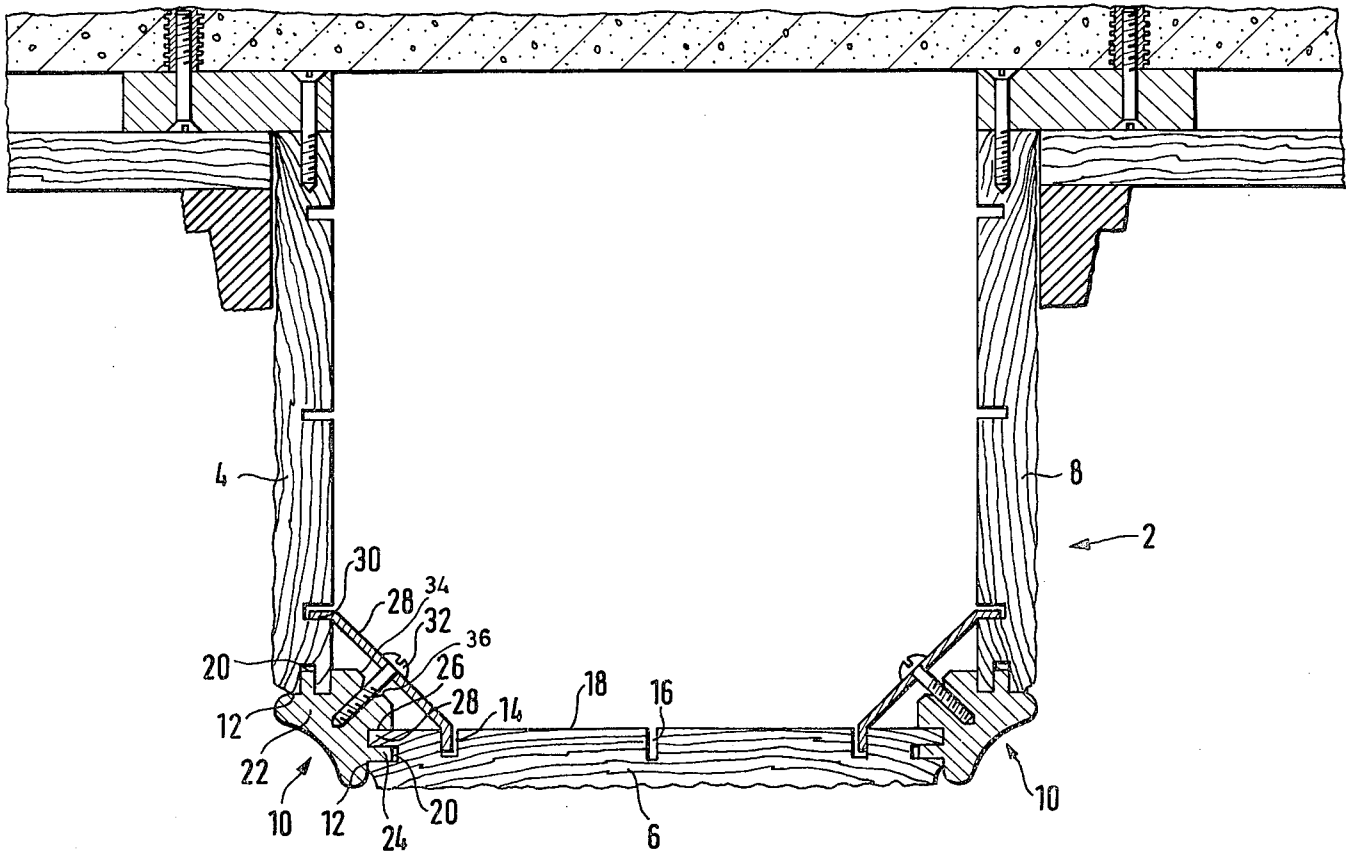
2
8
10
16
6
18
14
36
26
28
34
32
28
20
24
30
12
10
22
12
20
4

HOLLOW BEAM CONSTRUCTED OF BOARDS

The invention relates to a hollow beam in which at least at one corner, the edge regions of two adjacent boards are held together with the aid of a corner molding which is connected to each of the two adjacent boards by a tongue and groove connection extending in the longitudinal direction of the hollow beam.

In one known hollow beam of this type (German Patent No. 2,520,507), the corner molding lies in the interior of the hollow beam and is glued in the tongue and groove connection to the two adjacent boards. This design has the result that the assembly of the hollow beam is comparatively laborious.

The invention is based on the problem of providing a hollow beam which can be assembled more easily.

To solve this problem, the hollow beam according to the invention has longitudinally extending sides which are arranged in a beam-shape and incorporate corner members interconnecting adjacent pairs of sides to define respective corners of the beam. The corner members include longitudinally extending tongues and grooves which engage cooperating means provided on adjacent ones of the sides. There are a plurality of clips provided at spaced intervals along the length of each corner, and the opposed ends of the clips engage longitudinally extending recesses, such as grooves, formed into the inner surfaces of the sides adjacent the respective corner member. Attachment means, such as screws, securely connect each clip to the respective corner member.

By screwing together the clip and the corner molding, the two boards extending to the corner are drawn toward the corner and thereby their longitudinal edges near the corner are drawn against the corner molding. The corner molding need not necessarily be, but generally is, visible from the exterior. This is not annoying since, at its side visible from the exterior, the corner molding may have an outline which is decorative in appearance.

The clip ends are preferably bent over at least to a direction in which the clip ends are perpendicular to the inner face of the two boards extending to the corner. A bend farther toward the corner is likewise possible. Glueing between the boards and the corner molding can be omitted. Preferably, the two boards extending to the corner form an angle of 90° between one another. Preferably, a plurality of clips are at a spacing of 30 to 100 cm.

According to another feature of the invention, each clip means is so dimensioned as to terminate short of the bottom of the respective groove, so that when the respective screw constituting the attachment means is turned, the two ends of the respective clip means coact only with those side walls of the longitudinal grooves which are nearest the respective corner, thereby causing the clip means to draw the two sides against the respective corner member.

The invention will be explained in more detail below with reference to an illustrated embodiment. The sole FIGURE is a cross-sectional view through a three-sided hollow beam whose open side faces a ceiling and is screwed to the ceiling.

The illustrated hollow beam 2 is constructed of three boards 4, 6, and 8, the boards 4 and 6 as well as the boards 6 and 8 forming a right angle with one another. The boards 4 and 6 as well as the boards 6 and 8 are connected together at a respective corner 10 of the hollow beam. The two connections are completely identical in structure, so that a description of one of the two connections is sufficient.

At their rear sides, the boards 4, 6 and 8 are each provided with two longitudinal grooves 14 which extend in the vicinity of a respective longitudinal edge 12. Furthermore, in the center of each board 4, 6 and 8, at the rear side, there is provided a warp groove 16. The walls of the longitudinal grooves 14 extend perpendicularly to the inner sides 18 of the boards 4, 6 and 8.

The longitudinal edges 12, facing the corners 10, of the two boards 4 and 6 or 6 and 8 extending to the corners are each provided with a longitudinal groove 20. The two regions of a corner molding 22 which face the longitudinal edges 12 are each provided with longitudinally extending tongues 24, which fit into the corresponding longitudinal grooves 20. In addition to the tongues 24, a longitudinal groove 26 is provided at each corner molding, into which fits a corresponding, longitudinally extending projection 28' at the longitudinal edge of the corresponding boards 4, 6, 8. Thus, there is provided, so to speak, a double tongue and groove connection between the corner molding 22 and the longitudinal edge 12 of each adjoining board 4, 6, 8.

A clip 28 of sufficiently thick sheet metal extends at each corner 10 within the hollow beam 2 at an angle of 45° with respect to the two boards 4, 6 or 6, 8, respectively, which are to be connected at this corner 22. Both ends 30 of the clip 28, which face the boards 4, 6 or 6, 8 to be connected, are bent sufficiently in the direction toward the corner 10 that they extend perpendicularly with respect to the inner surfaces of the boards. One end 30 projects into a longitudinal groove 14 in the one board 4 and the other end 30 projects into a longitudinal groove in the other board 6. As is clearly shown in the drawing, the bent ends 30 of the clip 28 are so dimensioned as to terminate short of the bottom of the respective grooves 14, so that when a screw 32, which is screwed through a bore in the center of the clip from the interior of the hollow beam into the corner molding 22, is turned, the two ends 30 coact only with those side walls of the two longitudinal grooves 14 which are nearest the corner 10. Consequently, the clip draws the two boards 4, 6 or 6, 8 extending to the respective corner 10 against the corner molding 22, the tongue and groove connections between the corner molding 22 and the two boards preventing outward escape of the two boards.

In the illustrated embodiment, the hollow beam 2 is open at one side and thus has a U-shaped cross section. The free ends of the arms of the U can be fastened to a ceiling, for example by means of suitable retainer members, so that it is no longer apparent that the hollow beam 2 is open at one side.

The type of connection according to the invention can also be employed for hollow beams which are closed on four sides, in which case the corner connections of the board applied last must be tightened from the open frontal faces of the beam.

At its inner side, the corner molding 22 is provided with an oblique surface 34 which extends at approximately 45° to the planes of the boards 4 and 6 and substantially parallel to the major plane of the clip 28. The drawing shows, in cross section, a positioning groove 36 which extends in the center of the oblique surface 34 along the corner molding 22. The cross section is triangular. By means of the positioning groove 36, the tip of the screw 32 is automatically pulled into the correct, center position when the clip 28 is screwed to the corner molding 22.

The term "boards" employed in the text of this application is intended to relate to the shape of these members, i.e. elongate members having a thickness substantially smaller than their surface extent. Consequently, the term "board" could also be replaced by the term "elongate plates". In addition to solid wood, the elongate plates may also be made of plywood, compressed wood fiber material, plastic or the like, preferably in veneered form.

I claim:

1. A hollow beam having a U-shape cross section, there being three longitudinally extending sides which form the beam-shape and which constitute the base and arms of the U, respectively, the beam being open at the fourth side thereof which extends across the free ends of the arms of the U, the beam comprising:

corner members interconnecting adjacent pairs of said sides to define respective corners of said beam, said corner members including longitudinally extending tongue and groove means which engage cooperating means provided on adjacent ones of said sides;

a plurality of clip means provided at spaced intervals along the length of each respective corner, the opposed ends of said clip means engaging longitudinally extending recesses formed into the inner surfaces of said sides adjacent the respective corner member; and attachment means securely connecting each of said clip means to the respective corner member.

2. The hollow beam of claim 1, wherein each respective clip means extends diagonally across a respective corner of said beam, said opposed ends of each respective clip means being bent in a direction towards the respective corner.

3. The hollow beam of claim 2, wherein each corner member comprises a respective molding having, along its respective inner side, a longitudinally extending groove for guiding and receiving said attachment means, each of said attachment means being a respective screw member.

4. The hollow beam of claim 3, wherein said recesses are longitudinal grooves.

5. The hollow beam of claim 2, wherein each of said attachment means is a respective screw member, wherein said recesses are longitudinal grooves, and wherein said bent ends of each clip means are so dimensioned as to terminate short of the bottom of the respective groove, so that when the respective screw member is turned, the two ends of the respective clip means coact only with those side walls of the longitudinal grooves which are nearest to the respective corner, thereby causing the clip means to draw the two sides against the respective corner member.

6. The hollow beam of claims 1, 2, 3, 4 or 5, wherein each of said sides has a longitudinally extending warpage groove formed in the inner surface of the respective side at a point intermediate the edges of the respective side.

7. The hollow beam of claims 1, 2, 3, 4 or 5, wherein each of said sides is made of solid wood, plywood, compressed wood fiber material, or plastic.

* * * * *